United States Patent [19]

Ghiringhelli et al.

[11] 4,139,432

[45] Feb. 13, 1979

[54] PROCESS FOR ELECTROCHEMICALLY RECOVERING PRECIOUS METALS FROM ORES

[76] Inventors: Hugh A. Ghiringhelli, 436 Danbury Rd., Wilton, Conn. 06897; Kenneth S. Deffeyes, 40 Western Way, Princeton, N.J. 08540

[21] Appl. No.: 714,827

[22] Filed: Aug. 16, 1976

[51] Int. Cl.[2] ..... C25C 1/20

[52] U.S. Cl. ..... 204/110; 204/130

[58] Field of Search ..... 204/109–110, 204/130

[56] References Cited

U.S. PATENT DOCUMENTS

| | | | |
|---|---|---|---|
| 61,866 | 2/1867 | Rae | 204/110 |
| 3,673,061 | 6/1972 | Kruesi | 204/105 R |
| 3,836,443 | 9/1974 | MacGregor | 204/109 |

OTHER PUBLICATIONS

Bureau of Mines, R.I. 7023, 9/67, pp. 2–3, R. L. Andrews et al.

*Primary Examiner*—R. L. Andrews
*Attorney, Agent, or Firm*—Joseph L. Lazaroff; Alphonse R. Noe

[57] ABSTRACT

An electrochemical process for rapidly achieving the recovery of precious metals such as gold and silver from their ores. The ore is formed into a slurry and combined with an electrolyte such as sodium cyanide and an alkaline substance such as sodium hydroxide to increase alkalinity to at least 0.01 equiv./liter. The ore slurry and electrolyte are placed in a recovery apparatus in direct touching contact with closely spaced large area anodic and cathodic electrodes, preferably spaced apart by a distance of about 1 cm. or less. A voltage is applied to the electrodes to produce a current density in the slurry of about 10 to 20 amperes per square meter, and the slurry is agitated to provide diffusion of the ore grains into electrical contact with the electrodes to promote precious metal dissolution. The agitation further transports precious metal complexes to the cathode where the precious metal is electrolytically precipitated and the complexing agent freed for further electrolytic dissolution of the precious metal. The foregoing process and recovery apparatus markedly improve the rate of recovery of precious metals from their ores, reducing recovery times in some instances to less than 10 minutes from the 3 to 24 hours required in conventional cyanidation processes for comparable precious metal extraction.

11 Claims, 2 Drawing Figures

PROCESS FOR ELECTROCHEMICALLY RECOVERING PRECIOUS METALS FROM ORES

BACKGROUND OF THE INVENTION

1. Field of the Invention

This invention relates to an electrochemical process and apparatus for the recovery of precious metals, particularly silver and gold, from ores, including not only newly mined materials but also tailings, slags and dumps remaining from previous recovery and mining operations. More specifically, the present invention relates to improvements upon processes and apparatuses for electrolytic recovery of precious metals from ores by means of cyanide complexing agents.

2. Description of the Prior Art

A variety of processes and apparatuses have been developed for electrochemically treating ores for the purpose of recovering their precious metals, particularly silver and gold. Many processes, as exemplified by U.S. Pat. No. 601,068 to Von Siemens, use cyanidation treatments. Notwithstanding considerable efforts devoted to the development of various electrochemical processes and apparatuses for recovering precious metals, none have been capable of a level of performance which makes them commercially practical for processing low grade new ores, or for reprocessing the vast quantity of low grade precious metal-containing tailings, slags and dumps which are the remnants of previous recovery and mining operations. One prominent drawback of prior electrochemical recovery techniques is the slowness with which they permit recovery. Extraction of precious metals during conventional cyanidation typically takes 3 to 24 hours, necessitating a massive apparatus if worthwhile amounts of precious metal are to be obtained from low grade ores. For these and other reasons, electrochemical techniques for recovering precious metals from ores have not been commercially practical or successful.

SUMMARY OF THE INVENTION

A principal object of the present invention is to provide an improved electrochemical process and apparatus for recovery of precious metals from ores. Specific objects of the invention are to provide such a process and apparatus which are capable of recovering precious metals very rapidly, approaching the theoretical limit imposed by diffusion considerations, which permit recovery with reduced capital costs and reduced operating costs, which achieve high throughput with reasonably sized equipment sufficiently mobile for field processing, and which achieve high processing rates without the need for complicated devices or exotic or costly additives. Still another object of the invention is to provide such a process and apparatus which are suitable for use in commercial recovery of precious metals from low grade ores now considered to be too uneconomical to process.

We have discovered that when certain conditions are satisfied, the recovery of precious metals from ores can be accomplished, for many materials, in less than 10 minutes. In some instances, two-thirds of the silver in weathered tailings has been extracted in three minutes of electrochemical processing. In a preferred embodiment of the invention to be described hereinbelow in detail, the process for achieving the rapid recovery of precious metals such as silver or gold from their ores comprises forming a slurry of the ore admixed with a conventional electrolyte such as sodium cyanide and with a substance such as sodium hydroxide for increasing the alkalinity to at least about 0.01 equivalents/liter. The slurry is put into a recovery apparatus in contact with anodic and cathodic electrodes which are spaced apart by a distance of about 1 cm. or less, such as in a range of about 0.3 cm. to 1 cm., and which have a large surface area in relation to the interelectrode spacing, e.g., in the range of about 0.1 to 1 square meter per ton of ore to be put through the apparatus per day. A low voltage is impressed across the electrodes to provide a current density of about 10–20 amperes per square meter therebetween, and the ore slurry is agitated sufficiently to provide eddy diffusion of ore grains in the slurry to facilitate passage of the ore grains into electrical contact with the electrodes.

It is believed that the foregoing process steps and apparatus features contribute to rapid dissolution of the precious metals and compounds in at least three principal ways. First, under the above conditions, the process proceeds by means of dissolution reactions which require no net addition or consumption of oxygen which would limit the speed of the reaction, and no waste products are produced to contend with. The dissolved precious metals may be removed from the slurry for external precipitation. However, when electrolytic precipitation of the dissolved precious metal is allowed to proceed at the cathode, the complexing agent (e.g., sodium cyanide), is freed at the cathode and able to diffuse immediately back to participate in the reaction again. It is believed that this elimination of a need for an externally-supplied oxidant and the rapid recycling of reagents contributes to achieving rapid dissolution and precipitation reactions and thus high throughputs.

Second, the ore contains mineral grains including precious metals imbedded therein or as compounds. The grains are believed to be predominantly semiconductors or metallic conductors and as the grains are agitated into electrical contact with the electrodes, the grain surfaces themselves become electrodes and much faster dissolution rates are achieved. Moreover, the mineral grains have access to both anodic and cathodic electrodes, and thus preferential anodic or cathodic dissolution will take place. In a more detailed aspect of the invention, an alternating current is applied to the electrodes to cause them to alternately become cathodic and anodic, thereby to achieve both anodic and cathodic dissolution of the mineral grains then adjacent a single electrode.

Third, by maintaining the slurry with excess alkalinity, of at least about 0.01 equiv./liter, the dissolution of various compounds such as sulfides in the ore proceeds at a much higher rate.

Other objects, aspects and advantages of the invention will be pointed out in, or apparent from, the detailed description hereinbelow, considered together with the following drawings.

DESCRIPTION OF THE PREFERRED EMBODIMENTS

Figure 1:
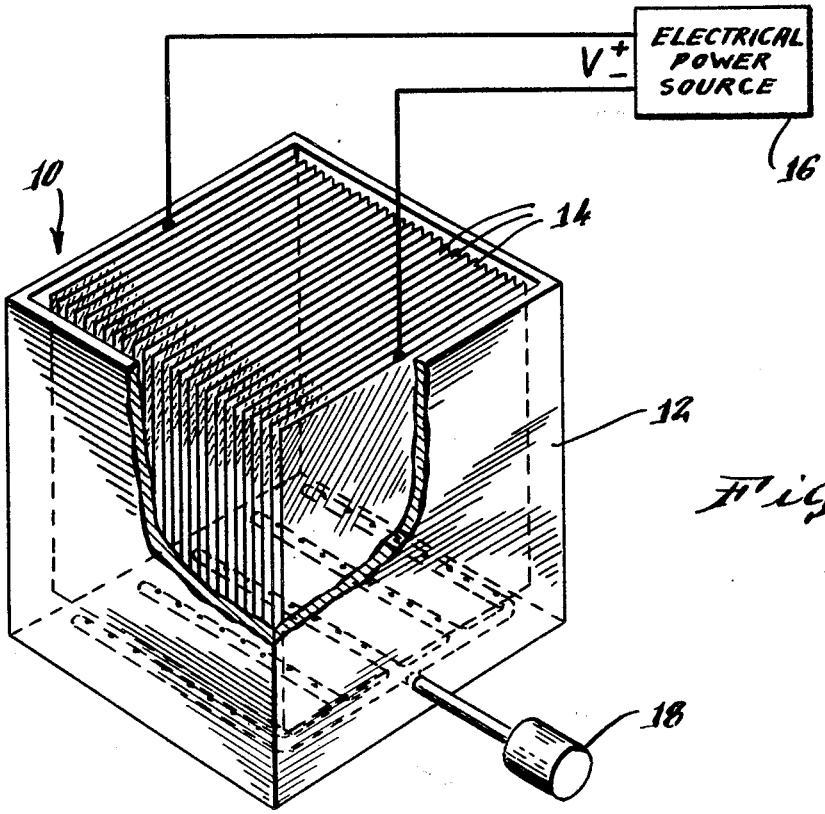
FIG. 1 is an essentially schematic perspective view with portions removed and in section, of an apparatus arranged in accordance with the present invention for the rapid recovery of precious metals from their ores.

FIG. 1 illustrates an apparatus 10 constructed in accordance with the present invention and used in a process according to the invention for the recovery of precious metals from aqueous slurries of ore admixed with an electrolyte. As illustrated in FIG. 1, the recovery apparatus 10 comprises a container 12, for example a cube with interior dimensions slightly greater than about one meter along each edge. Within container 12 are a multiplicity, e.g., 100, of closely spaced, parallel electrode plates 14, made for example from stainless steel, coated if desired with a selected electrocatalytic material, and being about one meter square. In accordance with the present invention, the spacing between the plates is about 1 cm. or less. The ratio of surface area of a plate to the volume between plates thus is large. The square root of the area is about 100 times the plate spacing distance.

The outermost plates are connected to the terminals of an electrical power source 16, which applies a voltage V to the series of plates 14. When container 12 is filled with an electrolyte, the voltage V is divided by the plates 14 and each adjacent pair of plates forms a bipolar electrolytic cell with one plate surface functioning as anode and the other plate surface as cathode. Since each plate 14 defines two cells, one side of the plate thus functions as an anode for one cell, and the other side of the same plate functions as a cathode for the next cell.

As shown in FIG. 1, container 12 further includes an air source 18 which introduces bubbles into the container to agitate the contents thereof so as to produce eddy diffusion between plates 14. Other means for achieving agitation, such as mechanical stirrers, hydraulic pumps, and the like, also can be used.

Figure 2:
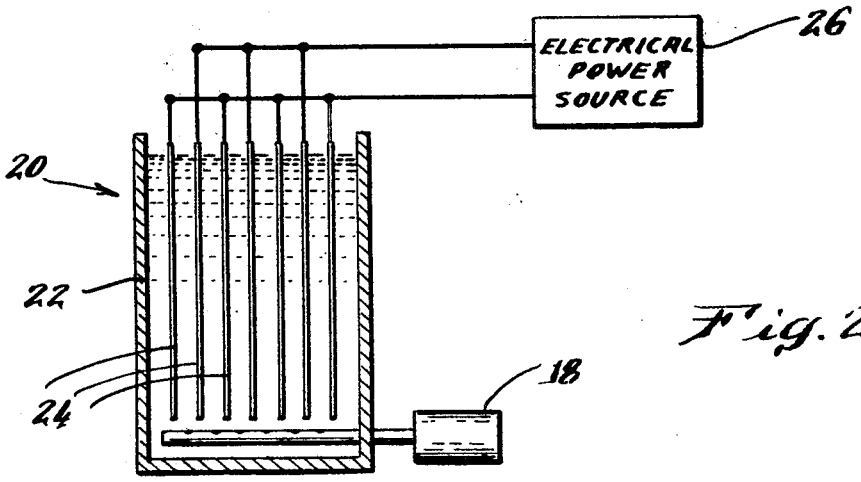
FIG. 2 is a schematic vertical sectional view of another apparatus in accordance with the invention.

FIG. 2 shows another recovery apparatus 20, wherein plates 24 in a container 22 are connected to a power source 26 with alternating plates connected to different terminals so that each plate functions only as a cathode or anode to adjacent cells.

Pursuant to the invention, an aqueous slurry is prepared with ore ground, for example, to −60 mesh. A conventional electrolyte, preferably sodium cyanide, is admixed with the ore slurry in dilute concentrations (e.g., 2 gm. of dry sodium cyanide per kilogram of ore or about $10^{-5}$ equivalents of cyanide per cc.). The solution is maintained with an excess alkalinity by adding a material such as sodium hydroxide to bring the alkalinity to at least about 0.01 equiv./liter. Preferably, in order to speed up the recovery process and improve extractability still further, as disclosed in our copending application Ser. No. 714,828, filed Aug. 16, 1976 and incorporated herein by reference, there is also added to the ore slurry a small quantity of a water-soluble electroconductive resin of the cationic type exemplified by the resin known as ECR-34, manufactured and sold by Dow Chemical Company, Midland, Michigan. Chemically this resin is a polyvinylbenzyltrimethylammoniumchloride.

The ore slurry and electrolyte are introduced into the recovery apparatus 10 or 20, either on a continuous or a batch basis. The power source 16 or 26 impresses a voltage across each pair of anodic and cathodic electrode surfaces, and in accordance with the invention, a current density of about 10 to 20 amperes per square meter is achieved. The agitator 18 is operated to provide eddy diffusion of the ore slurry, so as to bring about the physical displacement and transport of ore grains within the slurry and to cause them to contact the electrodes 14 or 24 for rapid dissolution.

The sodium cyanide reacts with the precious metals in the ore to form cyanide complexes, which are anionic and thus electrically urged toward the anodes. However, in accordance with the present invention, the precious metal-cyanide complexes are diffused by agitation to the cathodes and there precipitate the precious metal, freeing the cyanide to further react with the ore. The precipitated precious metal then may be recovered from the electrodes using conventional techniques.

It should be noted that in some instances it may be preferable to remove the dissolved precious metals from the slurry before they diffuse to the cathode, to allow them to be either electrolytically or chemically precipitated in another container. The freed cyanide, in such instances, can again be returned to the slurry for further use.

The electrical power source 16 or 26 may supply direct current for both dissolution and precipitation, or it may supply alternating current, e.g., with a frequency of 60 Hz, to cause each electrode surface to become alternately cathodic and anodic and promote dissolution by increasing the opportunities for each ore grain to contact the type of electrode with which it preferentially dissolves. For some grains, alternating contact with cathode and anode may strip away successive layers of minerals binding the precious metal.

EXAMPLES

The following specific example is illustrative of the practice of the invention. One kg. of tailings from a Nevada silver mill, left from a pre-1890 recovery process, was analyzed by x-ray fluorescence(accurate to ±20%) and found to contain about 20 oz. of silver per ton. Sufficient tap water was added to the tailings to form a slurry with a volume of 1000 c.c. Admixed with the slurry were: 2 grams of sodium hydroxide (dry), 2 grams of sodium cyanide (dry), and 0.15 c.c. of a 33.7% solids solution of the electroconductive resin ECR-34 manufactured by the Dow Chemical Company. The slurry was then placed in an apparatus similar to apparatus 20 of FIG. 2, containing 7 vertical plates of 304 stainless steel, 3 plates serving as cathodes with a total surface area of 1200 square centimeters, and 4 plates serving as anodes with a total surface area of 1600 sq. cm. The electrodes were spaced 0.3 cm. apart, and a voltage of 2.7 volts d.c. was impressed between each anode and cathode. A current of 2 amperes d.c. was drawn. The slurry was recirculated at room temperature (e.g. 25° C.) past the electrodes by means of an air lift formed with a miniature air pump connected to the container with tubing. The square root of the cathode area in each cell was about 47 times the interelectrode spacing.

Samples of the slurry were withdrawn after 2, 4, 8 and 16 minutes, and analyzed by x-ray fluorescence. After 2 minutes, the slurry contained about 11 oz. of silver per ton; after 4 minutes, 9.5 oz.; and after 8 and 16 minutes, less than 5 oz. per ton. In other words, the apparatus and process recovered about 9 oz./ton in 2 minutes; 10.5 oz./ton in 4 minutes; and 15 oz./ton in 8 minutes. This rapid recovery rate allows a small apparatus, which can be relatively mobile, to process large quantities of ore and obtain commercially valuable amounts of precious metal.

In a second illustrative example, gold-bearing telluride ore with a gold content, determined by fire assay, of 7.92 oz./ton was formed into a slurry by grinding 100 grams to −200 mesh and mixing with 200 grams of water. Sodium hydroxide was added to achieve an alkalinity of 0.3 equiv./liter. Dry sodium cyanide was added at the rate of 1.5 gm./kilogram of ore. The resin ECR-34 described above was added in the same concentration as the previous example. The slurry was placed in a stainless steel cup about 6 inches in diameter, connected as an anode, a single copper cathode was inserted, and a current of about 250 milliamperes was drawn. Agitation of the slurry was accomplished by mechanical stirring. Deposition of gold proceeded on the cathode. After 8 minutes the ore was drained and filtered, and determined by fire assay to have a remaining gold content of 0.88 oz./ton.

DISCUSSION

We thus have discovered that the recovery of precious metals for ores, tailings, mine dumps and slags can be accomplished, for many materials, in less than 10 minutes. In some instances, two-thirds of the silver in weathered tailings has been extracted during a three-minute pass through our device. The very short residence time in the precious metal extraction device allows a compact piece of equipment of modest cost to process a large tonnage of ore per day. Conventional means of accomplishing the same object, extraction of precious metals, typically takes 3 to 24 hours holding time during conventional cyanidation. This long time necessitates the massive tanks, filters, and thickeners typical of metallurgical plants. Moreover, the process achieves extraction of precious metals from carbonaceous ores which heretofore have proven refractory by conventional cyanidation techniques unless the ores were subjected first to oxidation of the carbon-bearing elements.

Our unexpected discovery is that a slurry of the finely ground ore mixed with a suitable electrolyte and at a high alkalinity can be passed over or through electrodes having a large surface area and the precious metal is dissolved and recovered directly and rapidly at the cathode surfaces. All of the complex flowsheet of a typical metallurgical plant is reduced to a single operation.

In retrospect, it is clear that if any of the several essential processes occurring within our device occurred at a slow rate, then the device would not achieve the favorable results we have obtained. In our process and apparatus we have discovered a way to simply and economically make each of the steps of the chemistry, of the mass transfer, and of the electrical transport to be substantially as rapid as is the one inherent rate-limiting step upon which we cannot improve.

The following discussion of the invention will indicate certain additional aspects of its practice:

1. The first requirement for electrochemical recovery is that the metals sought (gold and silver for example) either be the most mobile metals under the operating conditions, or else that any other metals of equal mobility be of modest enough amount in the ore that no major economic difficulty is raised if these other metals are recovered along with the precious metals. We have utilized the gold- and silver-cyanide complexes in most of our experiments as the metal transporting species. In addition, we have discovered that the addition of certain electroconductive resins can enhance transfer rates in cyanide solutions, as disclosed in our copending application, Ser. No. 714,828.

A certain degree of exclusion of non-noble metals can be obtained by operating the process at low cell voltages. Because silver and gold are the most noble metals in cyanide solution, they are the metals recovered at the minimum cell voltages.

In achieving this result of plating across gold and silver and leaving most other metals behind, we have reversed the common electrometallurgical practice of recovering or refining less noble metals to the cathodes, and leaving the precious metals behind as anode slimes.

2. One rate-governing step in the conventional cyanidation process is the supply of oxygen to dissolve the gold or silver. For instance, the dissolution of gold in conventional cyanidation of ore proceeds according to the equation:

$$4Au + 8NaCN + 2H_2O + O_2 = 4NaAu(CN)_2 + 4NaOH$$

The gold-cyanide complex is usually precipitated with zinc metal afterwards:

$$4NaAu(CN)_2 + 2\,Zn = 2Na_2Zn(CN)_4 + 4\,Au$$

Not only is the first reaction slow, but the net reaction given by summing the two reactions is:

$$8\,NaCN + 2H_2O + O_2 + 2Zn = 2Na_2Zn(CN)_4 + 4NaOH$$

The result is that oxygen, cyanide, and zinc are used and the products on the right-hand side of the net reaction are valueless. Even if the gold-cyanide complex were precipitated electrolytically:

$$4NaAu(CN)_2 + 4NaOH + 4\,e^- = 8NaCN + 4Au + 4\,OH^-,$$

the net reaction obtained by summing the electrolytic precipitation with the first equation above gives:

$$2H_2O + O_2 + 4\,e^- = 4OH^-$$

This shows that there is net oxygen consumption by the process, and it is the rate of supply of this oxygen to the gold surfaces that limits the speed of the overall process. This difficulty has long been recognized and many clever (but commercially unsuccessful) attempts have been made to supply oxidants to speed up conventional cyanidation.

In our process there is no net addition or consumption of oxygen, hence oxygen supply cannot be a rate-limiting factor. Electrolytic dissolution of a gold grain proceeds in our process according to the following equation:

$$Au + 2NaCN + OH^- = NaAu(CN)_2 + NaOH + e^-$$

Electrolytic precipitation proceeds by the same equation as electrolytic gold extraction following conventional cyanidation (with the common factor of 4 divided out of the earlier equation)

$$NaAu(CN)_2 + NaOH + e^- = Au + 2NaCN + OH^-$$

Because these last two reactions for electrolytic dissolution and electrolytic precipitation are exactly the reverse of one another, the net reaction is zero. Nothing is consumed, no waste products are produced, and the complexing agent (in this example, the sodium cyanide) is freed and is able to diffuse immediately back to participate in the reaction again.

This elimination of a need for an externally-supplied oxidant and the rapid recycling of reagents internally within our device contributes to our achieving rapid reactions and high throughputs.

3. There is one rate in our process that cannot be improved drastically: diffusion of the precious-metal species to the cathodes. Our successful results can be seen as having speeded up all the other steps until they approach the unimprovable and limiting rate of diffusion to the cathode.

The rate of diffusion of precious metal complexes to the cathode is readily computed from Fick's First Law:

$$Q = A\,D\,(dC^*/dx)$$

Where Q is the flow of precious metal to the cathode (equivalents/second), A is the cathode area ($cm^2$), D is the molecular diffusion coefficient ($cm^2$/sec), and $DC^*/dx$ is the concentration gradient (equivalents/$cm^4$). This expression states that if the concentration of precious metal is drawn down to zero at the cathode, then the reaction can go no faster than new precious metal atoms diffuse to the cathode.

If, as an example, we want to process 100 tons/day of a silver ore containing 300 parts per million by weight silver, the required rate, Q, is 0.003 equivalents/second. The diffusion coefficient, D, is $10^{-5}$ $cm^2$/sec. The concentration gradient cannot be made large under the conditions of mineral processing. First, the minerals being dissolved are relatively insoluble. Silver sulfide, silver chloride, and even silver cyanide are not very soluble in water. From the polarographic response of our electrolytes, it is our opinion that we are achieving concentrations of $10^{-6}$ equivalents/$cm^3$ of the silver cyanide complex. The distance over which diffusion takes place is approximately 0.0005 cm in well-stirred systems. Therefore the concentration gradient, $dC^*/dx$ is $10^{-6}/0.0005 = 0.002$ equivalents/$cm^4$. Now everything is defined in Fick's equation except the area, and we can then solve for the area. This comes out to be 150,000 $cm^2$, which is a minimum theoretical area if the process were ideally efficient. Although there are uncertainties in the numbers used for this calculation, it does emphasize that a large cathode area, such as that provided by the apparatus of FIG. 1 (1,000,000 $cm^2$) is appropriate for rapid recovery rates.

The diffusion calculation is a measure of comparison for the other rates in the process. We are currently achieving rates within a factor of 2 of the theoretical ideal rates. This emphasizes that the present invention has succeeded in speeding up the other chemical, hydraulic, and electrical transport processes to substantially match the diffusion limit. Further, it emphasizes that our success in rapid processing for precious metals is a success toward a theoretically achievable goal.

4. Increasing the voltage across our electrochemical cell does not, beyond a certain voltage, increase the rate of recovery. Increasing the voltage beyond that point only serves to liberate hydrogen instead of metals. However, the present invention is applicable as well to circumstances where high cell voltages are desirable. These circumstances arise where the concentration of precious metal is very low, as in the extraction of gold from a carbonaceous ore. In these ores the carbon also competes with the cathode in attracting the gold-cyanide complex. The ability of the cathode to attract the gold-cyanide complex more strongly than the carbon is determined by the Nernst equation, which indicates that at room temperature, a 60 millivolt increase in cell voltage results in a tenfold decrease in the concentration of metal dissolved in the solution at equilibrium.

Where maximum voltages are to be strived for, attempts may be made to decatalyze the competing reactions. For example, mercury cathodes may be used in order to decatalyze the liberation of hydrogen.

5. It is to be noted that the gold-cyanide and the silver-cyanide complexes are *anions.* The electrical migration of the ion is *away* from the cathode. The transport of the precious metal complexes to the cathodes thus is accomplished by hydraulic forces through one or more of several techniques, including air agitation, turbulent flow, or rapid circulation. It is believed that the use of the cationic resin ECR-34 of Dow Chemical Company may form cationic complexes helpful to transport of the precious metal to the cathode for precipitation.

6. Dissolution of minerals is a necessary part of a successful recovery process. Although the equations we cited earlier were for electrodissolution of flakes of free gold, there are other ores in which the gold occurs as minute grains imbedded within other minerals, such as pyrite. The occurrences of silver are even more complex, with the silver sometimes occurring in atom-for-atom substitution within lead and copper minerals such as galena and tetrahedrite. It is necessary to destroy these mineral grains in order to recover the included silver.

The present process achieves the electrochemical destruction of sulfide, telluride, and other compounds which contain major or minor amounts of precious metals. This is believed to occur because virtually all the mineral families which contain or enclose precious metals are semiconductors. As these grains touch the electrodes the grain surfaces themselves become electrodes and dissolution rates which are orders of magnitude faster than normal are achieved.

Moreover, in the process which we have developed, the mineral grains have access to both the anodes and the cathodes. By allowing the grains access to both cathode and anode three modes of action become possible:

(a) a selectivity in which those mineral grains that dissolve most rapidly anodically will do so and those grains that dissolve faster cathodically will do so.

(b) the exposure of single grains alternately to the cathode and the anode results in the stripping of insoluble surface layers that build up during dissolution at one electrode only.

(c) the use of alternating current, or partially rectified current in which alternating current is superimposed on direct current, low frequency alternating current, and various unsymmetrical waveforms can all be utilized to enhance dissolution.

It is possible that intermediate species, stable or unstable, such as oxygen, chlorine, or hypochlorite may be produced at the electrodes and migrate into the solution and there promote dissolution of mineral grains.

7. An essential component of any cell design in our invention is a large surface area, as shown by the Fick's Law diffusion calculation given earlier. We have utilized both parallel plate electrode geometries in which the slurry flows parallel to the plates and we have used open porous electrodes in which the ore flows through the electrodes.

In order to achieve the highest rates, we have employed anodes and cathodes spaced less than a centimeter apart. The close electrode spacing serves to minimize the time required for a given volume of slurry to be subjected to a given amount of electrical action, expressed in ampere-seconds (coulombs). The close spacing also improves the chance that an ore grain will have an opportunity for both anodic and cathodic dissolution.

By operating under the set of chemical, hydraulic, and electrical conditions which we have outlined, we find that it is possible to achieve a revolutionary increase in the speed with which precious metals can be extracted from their ores. The change of the time scale from 3 to 24 hours down to 3 to 10 minutes greatly reduces the physical size and the capital cost of the equipment required. In addition, many of the separate and discrete operations of conventional processes, such as phase separation and reagent recycling, are either eliminated or automatically internalized into the processes that occur between the electrodes in our invention.

Our process also achieves a number of environmental goals for metallurgical plants. There is no air pollution associated with roasting or smelting steps. The reagents are recycled for multiple use both internally within the electrochemical cells and externally after the slurry leaves the cells.

Although a specific embodiment of the invention has been disclosed herein in detail, it is to be understood that this is for the purpose of illustrating the invention, and should not be construed as necessarily limiting the invention, since it is apparent that many changes can be made to the disclosed structures by those skilled in the art to suit particular applications.

We claim:

1. A process for electrochemically treating ores to increase the rate of recoverability of precious metals electrolytically mobile therein, comprising:

forming a slurry of the ore;

mixing a cyanide complexing agent for the precious metal and the water soluble electroconductive catonic resin polyvinylbenzyltri-methylammonium chloride as an electrolyte in dilute concentrations suitable to provide mobility for the precious metal desired to be recovered with the ore slurry;

placing the ore slurry and electrolyte into direct touching contact with both anodic and cathodic electrodes;

applying a voltage across the electrodes effective to produce a current density in the ore slurry and electrolyte of about 10 to 20 amperes per square meter to dissolve the precious metal from the slurry; and agitating the ore slurry and electrolyte while the voltage is being applied and while in contact with the electrodes sufficiently to provide bulk diffusion of the ore grains in the slurry in a direction across the interelectrode space and to bring the grains into electrical contact with the electrodes to recover the metal by electrodeposition;

whereby the dissolution rate of the precious metals in the ore is increased and their rapid recovery is facilitated.

2. A process for electrochemically treating ores as claimed in claim 1 further comprising recovering the precious metal electrolytically at the cathode.

3. A process for electrochemically treating ores as claimed in claim 1 wherein the interelectrode spacing is within a range of about 0.3 cm to 1.0 cm.

4. A process for electrochemically treating ores as claimed in claim 1 wherein the precious metal to be recovered is gold or silver and alkalinity of the slurry is at least about 0.01 equivalents/liter.

5. A process for electrochemically treating ores as claimed in claim 4 wherein the electrolyte comprises sodium cyanide.

6. A process for electrochemically treating ores as claimed in claim 1 wherein the electrodes have surface areas of about 0.1 to 1 square meter per ton of ore to be processed per day.

7. A process for electrochemically treating ores as claimed in claim 1 wherein the voltage applied to the electrodes is maintained sufficiently low to prevent emission of hydrogen at the cathode.

8. A process for electrochemically treating ores as claimed in claim 1 wherein a d.c. voltage is applied to the electrodes.

9. A process for electrochemically treating ores as claimed in claim 1 wherein an a.c. voltage is applied to the electrodes to cause each electrode surface to alternately become cathodic and anodic.

10. A process for electrochemically treating ores as claimed in claim 1 wherein an a.c. voltage is first applied to the electrodes for dissolution of the precious metals, and thereafter a d.c. voltage is applied to the electrodes and the precious metals are recovered at the cathode.

11. A process for electrochemically treating ores as claimed in claim 1 further comprising maintaining the alkalinity of the slurry at at least about 0.01 equivalents per liter.

* * * * *